US009470045B2

(12) United States Patent
Robichaux et al.

(10) Patent No.: US 9,470,045 B2
(45) **Date of Patent: *Oct. 18, 2016**

(54) METHOD OF USING A ROTATING AND RECIPROCATING SWIVEL

(71) Applicant: Mako Rentals, Inc., Houma, LA (US)

(72) Inventors: Kip M. Robichaux, Houma, LA (US); Kenneth G. Caillouet, Thibodaux, LA (US); Terry P. Robichaux, Houma, LA (US)

(73) Assignee: Mako Rentals, Inc., Schriever, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/716,155

(22) Filed: May 19, 2015

(65) Prior Publication Data

US 2016/0040483 A1 Feb. 11, 2016

Related U.S. Application Data

(63) Continuation of application No. 13/600,569, filed on Aug. 31, 2012, now Pat. No. 9,033,052, which is a continuation-in-part of application No. 12/682,912, filed on Sep. 20, 2010, now Pat. No. 8,567,507.

(60) Provisional application No. 61/529,304, filed on Aug. 31, 2011.

(51) Int. Cl.

| | |
|---|---|
| ***E21B 7/12*** | (2006.01) |
| ***E21B 7/00*** | (2006.01) |
| ***E21B 33/038*** | (2006.01) |
| ***E21B 33/08*** | (2006.01) |
| ***E21B 17/05*** | (2006.01) |
| ***E21B 33/064*** | (2006.01) |

(52) U.S. Cl.

CPC ..... *E21B 17/05* (2013.01); *E21B 7/00* (2013.01); *E21B 7/12* (2013.01); *E21B 33/038* (2013.01); *E21B 33/064* (2013.01); *E21B 33/085* (2013.01)

(58) Field of Classification Search

CPC .... E21B 17/05; E21B 33/038; E21B 33/085; E21B 7/00; E21B 7/12

USPC ..... 166/358, 359, 344, 345, 367, 386, 385, 166/291, 292, 155, 381, 177.4

See application file for complete search history.

(56) References Cited

U.S. PATENT DOCUMENTS

| | | | | |
|---|---|---|---|---|
| 6,244,345 | B1 * | 6/2001 | Helms | E21B 7/067 166/301 |
| 9,033,052 | B2 * | 5/2015 | Robichaux | E21B 7/12 166/344 |
| 2014/0116781 | A1 * | 5/2014 | Kuttel | E21B 7/00 175/57 |

* cited by examiner

*Primary Examiner* — James G Sayre

(74) *Attorney, Agent, or Firm* — Garvey, Smith, Nehrbass & North LLC; Brett A. North

(57) ABSTRACT

What is provided is a method and apparatus wherein a rotating and reciprocating swivel can be detachably connected to an annular blowout preventer thereby separating the drilling fluid or mud into upper and lower sections with the mandrel of the swivel being comprised of double box end joints and using double pin end subs to connect a plurality of such mandrel joints together.

11 Claims, 12 Drawing Sheets

METHOD OF USING A ROTATING AND RECIPROCATING SWIVEL

CROSS-REFERENCE TO RELATED APPLICATIONS

This application is a continuation of U.S. patent application Ser. No. 13/600,569 filed Aug. 31, 2012 (issued as U.S. Pat. No. 9,033,052 on May 19, 2015), which claims benefit of U.S. Provisional Patent Application Ser. No. 61/529,304, filed Aug. 31, 2011, which is incorporated herein by reference and to which priority is claimed.

This application is a continuation of U.S. patent application Ser. No. 13/600,569 filed Aug. 31, 2012 (issued as U.S. Pat. No. 9,033,052 on May 19, 2015), which is a continuation in part of U.S. patent application Ser. No. 12/682,912, filed Sep. 20, 2010 (issued as U.S. Pat. No. 8,567,507 on Oct. 29, 2013).

STATEMENT REGARDING FEDERALLY SPONSORED RESEARCH OR DEVELOPMENT

Not applicable

REFERENCE TO A "MICROFICHE APPENDIX"

Not applicable

BACKGROUND

In deepwater drilling rigs, marine risers extending from a wellhead fixed on the ocean floor have been used to circulate drilling fluid or mud back to a structure or rig. The riser must be large enough in internal diameter to accommodate a drill string or well string that includes the largest bit and drill pipe that will be used in drilling a borehole. During the drilling process drilling fluid or mud fills the riser and wellbore.

After drilling operations, when preparing the wellbore and riser for production, it is desirable to remove the drilling fluid or drilling mud. Removal of drilling fluid or drilling mud is typically done through a displacement using a completion fluid.

Because of its relatively high cost, this drilling fluid or drilling mud is typically recovered for use in another drilling operation. Displacing the drilling fluid or drilling mud in multiple sections is desirable because the amount of drilling fluid or mud to be removed during completion is typically greater than the storage space available at the drilling rig for either completion fluid and/or drilling fluid or drilling mud.

It is contemplated that the term drill string or well string as used herein includes a completion string and/or displacement string. It is believed that rotating the drill string or well string (e.g., completion string) during the displacement process helps to better remove the drilling fluid or mud along with down hole contaminants such as mud, debris, and/or other items. It is believed that reciprocating the drill or well string during the displacement process also helps to loosen and/or remove unwanted downhole items by creating a plunging effect. Reciprocation can also allow scrapers, brushes, and/or well patrollers to better clean desired portions of the walls of the well bore and casing, such as where perforations will be made for later production.

During displacement there is a need to allow the drilling fluid or mud to be displaced in two or more sections. During displacement there is a need to prevent intermixing of the drilling fluid or mud with displacement fluid. During displacement there is a need to allow the drill or well string to rotate while the drilling fluid or mud is separated into two or more sections.

During displacement there is a need to allow the drill string or well string to reciprocate longitudinally while the drilling fluid or mud is separated into two or more sections.

BRIEF SUMMARY

The method and apparatus of the present invention solves the problems confronted in the art in a simple and straightforward manner.

One embodiment relates to a method and apparatus for deepwater rigs. In particular, one embodiment relates to a method and apparatus for removing or displacing working fluids in a well bore and riser.

In one embodiment displacement is contemplated in water depths in excess of about 5,000 feet (1,524 meters).

One embodiment provides a method and apparatus having a swivel which can operably and/or detachably connect to an annular blowout preventer thereby separating the drilling fluid or mud into upper and lower sections and allowing the drilling fluid or mud to be displaced in two stages or operations under a well control condition.

In one embodiment a swivel can be used having a sleeve or housing that is rotatably and sealably connected to a mandrel. The swivel can be incorporated into a drill or well string.

In one embodiment the sleeve or housing can be fluidly sealed to and/or from the mandrel.

In one embodiment the sleeve or housing can be fluidly sealed with respect to the outside environment.

In one embodiment the sealing system between the sleeve or housing and the mandrel is designed to resist fluid infiltration from the exterior of the sleeve or housing to the interior space between the sleeve or housing and the mandrel.

In one embodiment the sealing system between the sleeve or housing and the mandrel is designed to resist fluid infiltration from the interior space between the sleeve or housing and the mandrel to the exterior.

In one embodiment the sealing system between the sleeve or housing and the mandrel has a substantially equal pressure ratings for pressures tending to push fluid from the exterior of the sleeve or housing to the interior space between the sleeve or housing and the mandrel than pressures tending to push fluid from the interior space between the sleeve or housing and the mandrel to the exterior of the sleeve or housing.

In one embodiment a swivel having a sleeve or housing and mandrel is used having at least one flange, catch, or upset to restrict longitudinal movement of the sleeve or housing relative to the annular blow out preventer. In one embodiment a plurality of flanges, catches, or upsets are used. In one embodiment the plurality of flanges, catches, or upsets are longitudinally spaced apart with respect to the sleeve or housing.

The rotating and reciprocating tool can be closed on by the annular blowout preventer ("annular BOP"). Typically, the annular BOP is located immediately above the ram BOP which ram BOP is located immediately above the sea floor and mounted on the well head. As an integral part of the string, the mandrel of the rotating and reciprocating tool supports the full weight, torque, and pressures of the entire string located below the mandrel.

In one embodiment, at least partly during the time the annular seal is closed on the sleeve of the swivel, the drill or well string is intermittently reciprocated longitudinally during downhole operations, such as a frak job. In one embodiment the rotational speed is reduced during the time periods that reciprocation is not being performed. In one embodiment the rotational speed is reduced from about 60 revolutions per minute to about 30 revolutions per minute when reciprocation is not being performed. In one embodiment, at least partly during the time the annular seal is closed on the sleeve of the swivel, the drill or well string is reciprocated longitudinally. In one embodiment a reciprocation stroke of about 65.5 feet (20 meters) is contemplated. In one embodiment about 20.5 feet (6.25 meters) of the stroke is contemplated for allowing access to the bottom of the well bore. In one embodiment about 35, about 40, about 45, and/or about 50 feet (about 10.67, about 12.19, about 13.72, and/or about 15.24 meters) of the stroke is contemplated for allowing at least one pipe joint-length of stroke during reciprocation. In one embodiment reciprocation is performed up to a speed of about 20 feet per minute (6.1 meters per minute).

In one embodiment, at least partly during the time the annular seal is closed on the sleeve of the swivel, the drill or well string is reciprocated longitudinally the distance of at least about 1 inch (2.54 centimeters), about 2 inches (5.08 centimeters), about 3 inches (7.62 centimeters), about 4 inches (10.16 centimeters), about 5 inches (12.7 centimeters), about 6 inches (15.24 centimeters), about 1 foot (30.48 centimeters), about 2 feet (60.96 centimeters), about 3 feet (91.44 centimeters), about 4 feet (1.22 meters), about 6 feet (1.83 meters), about 10 feet (3.048 meters), about 15 feet (4.57 meters), about 20 feet (6.096 meters), about 25 feet (7.62 meters), about 30 feet (9.14 meters), about 35 feet (10.67 meters), about 40 feet (12.19 meters), about 45 feet (13.72 meters), about 50 feet (15.24 meters), about 55 feet (16.76 meters), about 60 feet (18.29 meters), about 65 feet (19.81 meters), about 70 feet (21.34 meters), about 75 feet (22.86 meters), about 80 feet (24.38 meters), about 85 feet (25.91 meters), about 90 feet (27.43 meters), about 95 feet (28.96 meters), and about 100 feet (30.48 meters) during displacement of fluid and/or between the ranges of each and/or any of the above specified lengths.

In various embodiments, the height of the swivel's sleeve or housing compared to the length of its mandrel is between two and thirty times. Alternatively, between two and twenty times, between two and fifteen times, two and ten times, two and eight times, two and six times, two and five times, two and four times, two and three times, and two and two and one half times. Also alternatively, between 1.5 and thirty times, 1.5 and twenty times, 1.5 and fifteen times, 1.5 and ten times, 1.5 and eight times, 1.5 and six times, 1.5 and five times, 1.5 and four times, 1.5 and three times, 1.5 and two times, 1.5 and two and one half times, and 1.5 and two times.

In one embodiment one or more brushes and/or scrapers are used in the method and apparatus.

In one embodiment a mule shoe is used in the method and apparatus.

Catches

The annular BOP is designed to fluidly seal on a large range of different sized items—e.g., from 0 inches to 18¾ inches (0 to 47.6 centimeters) (or more). However, when an annular BOP fluid seals on the sleeve of the rotating and reciprocating tool, fluid pressures on the sleeve's exposed effective cross sectional area exert longitudinal forces on the sleeve. These longitudinal forces are the product of the fluid pressure on the sleeve and the sleeve's effective cross sectional area. Where different pressures exist above and below the annular BOP (which can occur in completions having multiple stages), a net longitudinal force will act on the sleeve tending to push it in the direction of the lower fluid pressure. If the differential pressure is large, this net longitudinal force can overcome the frictional force applied by the closed annular BOP on the sleeve and the fractional forces between the sleeve and the mandrel. If these frictional forces are overcome, the sleeve will tend to slide in the direction of the lower pressure and can be "pushed" out of the closed annular BOP. In one embodiment catches are provided which catch onto the annular BOP to prevent the sleeve from being pushed out of the closed annular BOP.

For example, lighter sea water above the annular BOP seal and heavier drilling mud, or weighted pills, and/or weighted completion fluid, or a combination of all of these can be below the annular BOP requiring an increased pressure to push such fluids from below the annular BOP up through the choke line and into the rig (at the selected flow rate). This pressure differential (in many cases causing a net upward force) acts on the effective cross sectional area of the tool defined by the outer diameter of the string (or mandrel) and the outer diameter of the sleeve. For example, the outer sealing diameter of the tool sleeve can be 9¾ inches (24.77 centimeters) and the outer diameter of the tool mandrel can be 7 inches (17.78 centimeters) providing an annular cross sectional area of 9¾ inches (24.77 centimeters) OD and 7 inches ID (17.78 centimeters). Any differential pressure will act on this annular area producing a net force in the direction of the pressure gradient equal to the pressure differential times the effective cross sectional area. This net force produces an upward force which can overcome the frictional force applied by the annular BOP closed on the tool's sleeve causing the sleeve to be pushed in the direction of the net force (or slide through the sealing element of the annular BOP). To resist sliding through the annular BOP, catches can be placed on the sleeve which prevent the sleeve from being pushed through the annular BOP seal.

In an of the various embodiments the following differential pressures (e.g., difference between the pressures above and below the annular BOP seal) can be axially placed upon the sleeve or housing against which the catches can be used to prevent the sleeve from being axially pushed out of the annular BOP (even when the annular BOP seal has been closed)—in pounds per square inch: 500, 750, 1000, 1250, 1500, 1750, 2000, 2250, 2500, 2750, 3000, 3250, 3,500, 3750, 4,000, 4,250, 4,500, 4,750, 5,000, or greater (3,450, 5,170, 6,900, 8,620, 10,340, 12,070, 13,790, 15,510, 17,240, 18,960, 20,690, 22,410, 24,130, 25,860, 27,700, 29,550, 31,400, 33,240, 35,090, 36,940 kilopascals). Additionally, ranges between any two of the above specified pressures are contemplated. Additionally, ranges above any one of the above specified pressures are contemplated. Additionally, ranges below any one of the above specified pressures are contemplated. This differential pressures can be higher below the annular BOP seal or above the annular BOP seal.

Quick Lock/Quick Unlock

After the sleeve and mandrel have been moved relative to each other in a longitudinal direction, a downhole/underwater locking/unlocking system is needed to lock the sleeve in a longitudinal position relative to the mandrel (or at least restricting the available relative longitudinal movement of the sleeve and mandrel to a satisfactory amount compared to the longitudinal length of the sleeve's effective sealing area). Additionally, an underwater locking/unlocking system is needed which can lock and/or unlock the sleeve and mandrel a plurality of times while the sleeve and mandrel are underwater.

In one embodiment is provided a system wherein the underwater position of the longitudinal length of the sleeve's sealing area (e.g., the nominal length between the catches) can be determined with enough accuracy to allow positioning of the sleeve's effective sealing area in the annular BOP for closing on the sleeve's sealing area. After the sleeve and mandrel have been longitudinally moved relative to each other when the annular BOP was closed on the sleeve, it is preferred that a system be provided wherein the underwater position of the sleeve can be determined even where the sleeve has been moved outside of the annular BOP.

In one embodiment is provided a quick lock/quick unlock system for locating the relative position between the sleeve and mandrel. Because the sleeve can reciprocate relative to the mandrel (i.e., the sleeve and mandrel can move relative to each other in a longitudinal direction), it can be important to be able to determine the relative longitudinal position of the sleeve compared to the mandrel at some point after the sleeve has been reciprocated relative to the mandrel. For example, in various uses of the rotating and reciprocating tool, the operator may wish to seal the annular BOP on the sleeve sometime after the sleeve has been reciprocated relative to the mandrel and after the sleeve has been removed from the annular BOP.

To address the risk that the actual position of the sleeve relative to the mandrel will be lost while the tool is underwater, a quick lock/quick unlock system can detachably connect the sleeve and mandrel. In a locked state, this quick lock/quick unlock system can reduce the amount of relative longitudinal movement between the sleeve and the mandrel (compared to an unlocked state) so that the sleeve can be positioned in the annular BOP and the annular BOP relatively easily closed on the sleeve's longitudinal sealing area. Alternatively, this quick lock/quick unlock system can lock in place the sleeve relative to the mandrel (and not allow a limited amount of relative longitudinal movement). After being changed from a locked state to an unlocked state, the sleeve can experience its unlocked amount of relative longitudinal movement.

In one embodiment is provided a quick lock/quick unlock system which allows the sleeve to be longitudinally locked and/or unlocked relative to the mandrel a plurality of times when underwater. In one embodiment the quick lock/quick unlock system can be activated using the annular BOP.

In one embodiment the sleeve and mandrel can rotate relative to one another even in both the activated and un-activated states. In one embodiment, when in a locked state, the sleeve and mandrel can rotate relative to each other. This option can be important where the annular BOP is closed on the sleeve at a time when the string (of which the mandrel is a part) is being rotated. Allowing the sleeve and mandrel to rotate relative to each other, even when in a locked state, minimizes wear/damage to the annular BOP caused by a rotationally locked sleeve (e.g., sheer pin) rotating relative to a closed annular BOP. Instead, the sleeve can be held fixed rotationally by the closed annular BOP, and the mandrel (along with the string) rotate relative to the sleeve.

In one embodiment, when the locking system of the sleeve is in contact with the mandrel, locking/unlocking is performed without relative rotational movement between the locking system of the sleeve and the mandrel—otherwise scoring/scratching of the mandrel at the location of lock can occur. In one embodiment, this can be accomplished by rotationally connecting to the sleeve the sleeve's portion of quick lock/quick unlock system. In one embodiment a locking hub is provided which is rotationally connected to the sleeve.

In one embodiment a quick lock/quick unlock system on the rotating and reciprocating tool can be provided allowing the operator to lock the sleeve relative to the mandrel when the rotating and reciprocating tool is downhole/underwater. Because of the relatively large amount of possible stroke of the sleeve relative to the mandrel (i.e., different possible relative longitudinal positions), knowing the relative position of the sleeve with respect to the mandrel can be important. This is especially true at the time the annular BOP is closed on the sleeve. The locking position is important for determining relative longitudinal position of the sleeve along the mandrel (and therefore the true underwater depth of the sleeve) so that the sleeve can be easily located in the annular BOP and the annular BOP closed/sealed on the sleeve.

During the process of moving the rotating and reciprocating tool underwater and downhole, the sleeve can be locked relative to the mandrel by a quick lock/quick unlock system. In one embodiment the quick lock/quick unlock system can, relative to the mandrel, lock the sleeve in a longitudinal direction. In one embodiment the sleeve can be locked in a longitudinal direction with the quick lock/quick unlock system, but the sleeve can rotate relative to the mandrel during the time it is locked in a longitudinal direction. In one embodiment the quick lock/quick unlock system can simultaneously lock the sleeve relative to the mandrel, in both a longitudinal direction and rotationally. In one embodiment the quick lock/quick unlock system can relative to the mandrel, lock the sleeve rotationally, but at the same time allow the sleeve to move longitudinally.

General Method Steps

In one embodiment the method can comprise the following steps:

(a) lowering the rotating and reciprocating tool to the annular BOP, the tool comprising a sleeve and mandrel;

(b) after step "a", having the annular BOP close on the sleeve;

(c) after step "b", causing relative longitudinal movement between the sleeve and the mandrel; and (d) after step "c", performing wellbore operations.

In various embodiments the method can include one or more of the following additional steps:

(1) after step "c", moving the sleeve outside of the annular BOP;

(2) after step "(1)", moving the sleeve inside of the annular BOP and having the annular BOP close on the sleeve;

(3) after step "(2)", causing relative longitudinal movement between the sleeve and the mandrel.

In one embodiment, during step "a", the sleeve is longitudinally locked relative to the mandrel.

In one embodiment, after step "b", the sleeve is unlocked longitudinally relative to the mandrel.

In one embodiment, after step "c", the sleeve is longitudinally locked relative to the mandrel.

In one embodiment, during step "c" operations are performed in the wellbore.

In one embodiment, during step "(3)" operations are performed in the wellbore.

In one embodiment, during step "c" the tool is fluidly connected to a string having a bore and fluid is pumped through at least part of the string's bore.

In one embodiment, during step "(3)" the tool is fluidly connected to a string having a bore and fluid is pumped through at least part of the string's bore.

In one embodiment, during step "c" the tool is fluidly connected to a string having a bore and fluid is pumped through at least part of the string's bore and a jetting tool is used to jet a portion of the wellbore, BOP, and/or riser. In one embodiment the jetting tool is a SABS jetting tool.

In one embodiment, during step "(3)" the tool is fluidly connected to a string having a bore and fluid is pumped through at least part of the string's bore and a jetting tool is used to jet a portion of the wellbore, BOP, and/or riser. In one embodiment the jetting tool is a SABS jetting tool.

In one embodiment, longitudinally locking the sleeve relative to the mandrel shortens an effective stroke length of the sleeve from a first stroke to a second stroke.

In one embodiment, during step "a", the mandrel can freely rotate relative to the sleeve.

In one embodiment, after step "b", the mandrel can freely rotate relative to the sleeve.

In one embodiment, after step "c", the mandrel can freely rotate relative to the sleeve.

To provide the completion engineers with the flexibility:

(a) to use the rotating and reciprocating tool while the annular BOP is sealed on the sleeve and while taking return flow up the choke or kill line (i.e., around the annular BOP); or (b) to open the annular BOP and take returns up the subsea riser (i.e., through the annular BOP); or (c) to open the annular BOP and move the completion string with the attached rotating and reciprocating tool out of the annular BOP (such as where the completion engineer wishes to use the SABs jetting tool to jet the BOP stack or perform other operations required the completion string to be raised to a point beyond where the effective stroke capacity of the rotating and reciprocating tool can absorb the upward movement by the sleeve moving longitudinally relative to the mandrel) and, at a later point in time, reseal the annular BOP on the sleeve of the rotating and reciprocating tool.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

During drilling, displacement, and/or completion operations it may be desirable to perform down hole operations when the annular seal of an annular blow out preventer is closed on the drill string and rotation and/or reciprocation of the drill string is desired. One such operation can be a frac (or fracturing) operation where pressure below the annular seal 71 is increased in an attempt to fracture the down hole formation.

Figure 1:
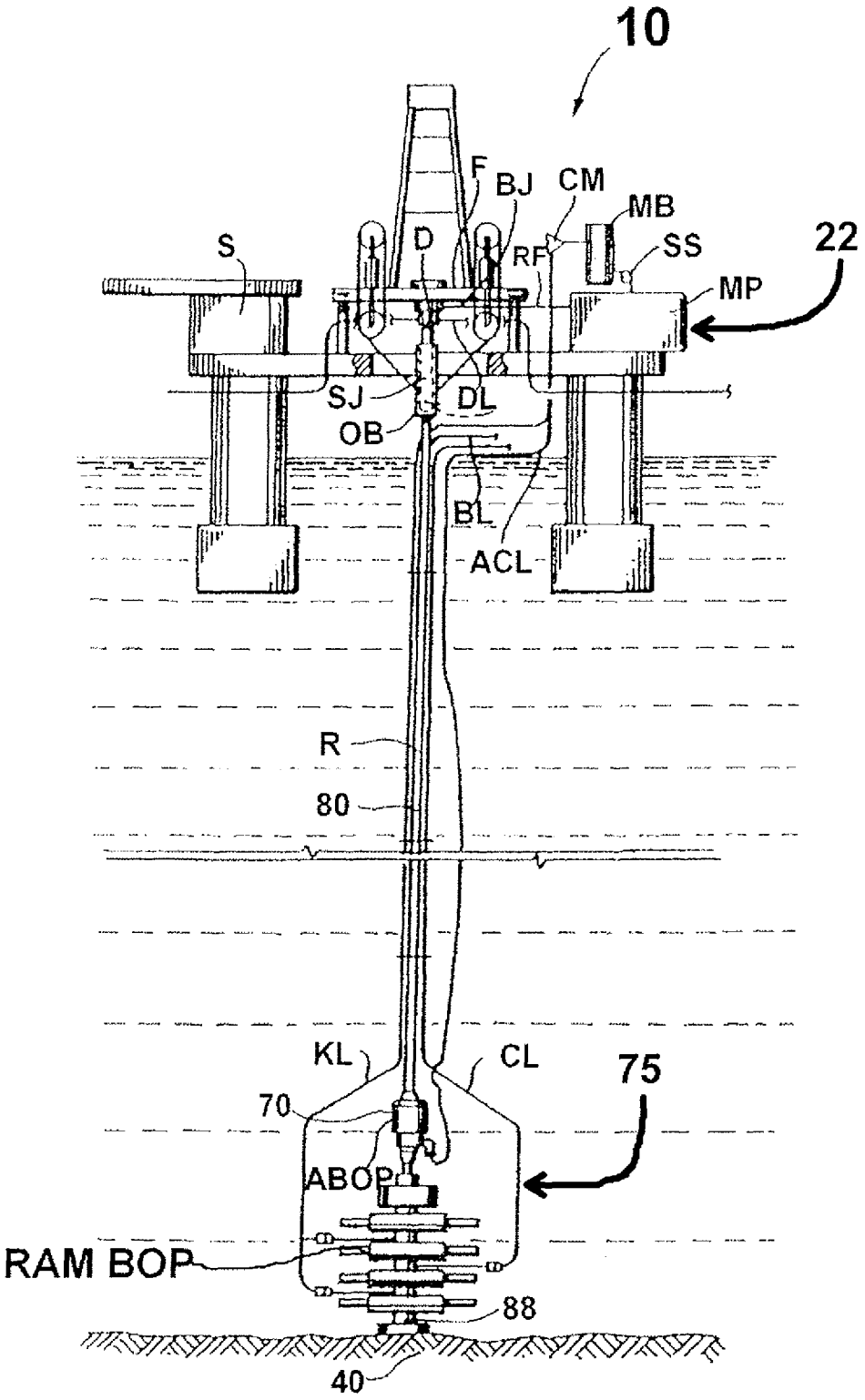
FIG. 1 is a schematic diagram showing a deep water drilling rig with riser and annular blowout preventer.
Figure 2:
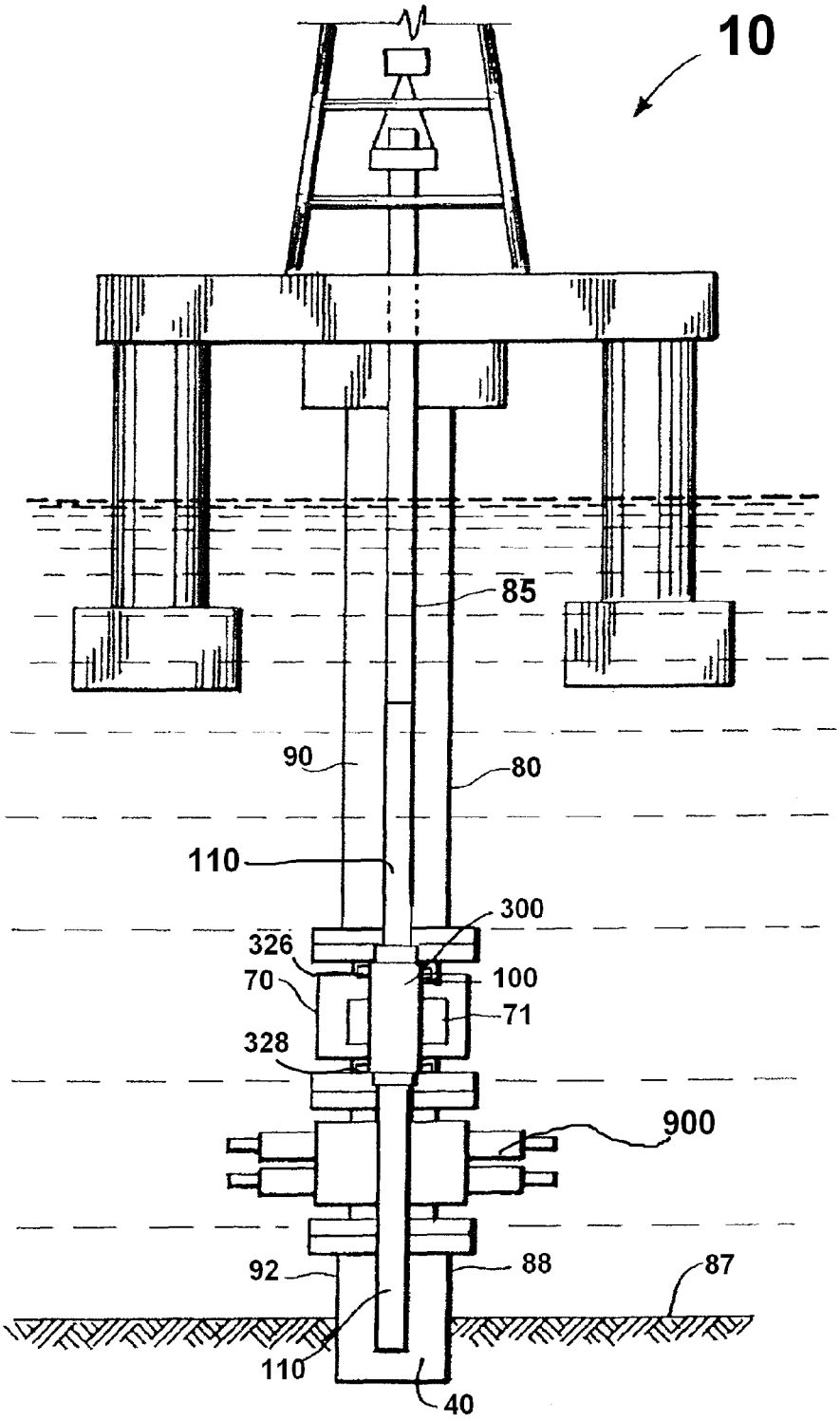
FIG. 2 is another schematic diagram of a deep water drilling rig showing a rotating and reciprocating swivel detachably connected to an annular blowout preventer, along with a ram blow out preventer mounted in the christmas tree below the annular blowout preventer.

FIGS. 1 and 2 show generally the preferred embodiment of the apparatus of the present invention, designated generally by the numeral 10. Drilling apparatus 10 employs a drilling platform S that can be a floating platform, spar, semi-submersible, or other platform suitable for oil and gas well drilling in a deep water environment. For example, the well drilling apparatus 10 of FIGS. 1 and 2 and related method can be employed in deep water of for example deeper than 5,000 feet (1,500 meters), 6,000 feet (1,800 meters), 7,000 feet (2,100 meters), 10,000 feet (3,000 meters) deep, or deeper.

In FIGS. 1 and 2, an ocean floor or seabed 87 is shown. Wellhead 88 is shown on seabed 11. One or more blowout preventers can be provided including stack 75 and annular blowout preventer 70. The oil and gas well drilling platform S thus can provide a floating structure S having a rig floor F that carries a derrick and other known equipment that is used for drilling oil and gas wells. Floating structure S provides a source of drilling fluid or drilling mud 22 contained in mud pit MP. Equipment that can be used to recirculate and treat the drilling mud can include for example a mud pit MP, shale shaker SS, mud buster or separator MB, and choke manifold CM.

An example of a drilling rig and various drilling components is shown in FIG. 1 of U.S. Pat. No. 6,263,982 (which patent is incorporated herein by reference). In FIGS. 1 and 2 conventional slip or telescopic joint SJ, comprising an outer barrel OB and an inner barrel IB with a pressure seal therebetween can be used to compensate for the relative vertical movement or heave between the floating rig S and the fixed subsea riser R. A Diverter D can be connected between the top inner barrel IB of the slip joint SJ and the floating structure or rig S to control gas accumulations in the riser R or low pressure formation gas from venting to the rig floor F. A ball joint BJ between the diverter D and the riser R can compensate for other relative movement (horizontal and rotational) or pitch and roll of the floating structure S and the riser R (which is typically fixed).

The diverter D can use a diverter line DL to communicate drilling fluid or mud from the riser R to a choke manifold CM, shale shaker SS or other drilling fluid or drilling mud receiving device. Above the diverter D can be the flowline RF which can be configured to communicate with a mud pit MP. A conventional flexible choke line CL can be configured to communicate with choke manifold CM. The drilling fluid or mud can flow from the choke manifold CM to a mud-gas buster or separator MB and a flare line (not shown). The drilling fluid or mud can then be discharged to a shale shaker SS, and mud pits MP. In addition to a choke line CL and kill line KL, a booster line BL can be used.

FIG. 2 is an enlarged view of the drill string or work string 85 that extends between rig 10 and seabed 87 having wellhead 88. In FIG. 2, the drill string or work string 85 is divided into an upper drill or work string and a lower drill or work string. Upper string is contained in riser 80 and extends between well drilling rig S and swivel 100. An upper volumetric section 90 is provided within riser 80 and in between drilling rig 10 and swivel 100. A lower volumetric section 92 is provided in between wellhead 88 and swivel 100. The upper and lower volumetric sections 90, 92 are more specifically separated by annular seal unit 71 that forms a seal against sleeve 300 of swivel 100. Annular blowout preventer 70 is positioned at the bottom of riser 80 and above stack 75. A well bore 40 extends downwardly from wellhead 88 and into seabed 87. Although shown in FIG. 2, in many of the figures the lower completion or drill string 86 has been omitted for purposes of clarity.

FIGS. 1 and 2 are schematic views showing oil and gas well drilling rig 10 connected to riser 80 and having annular blowout preventer 70 (commercially available). FIG. 2 is a schematic view showing rig 10 with swivel 100 separating. Swivel 100 is shown detachably connected to annular blowout preventer 70 through annular packing unit seal 71.

Figure 5:
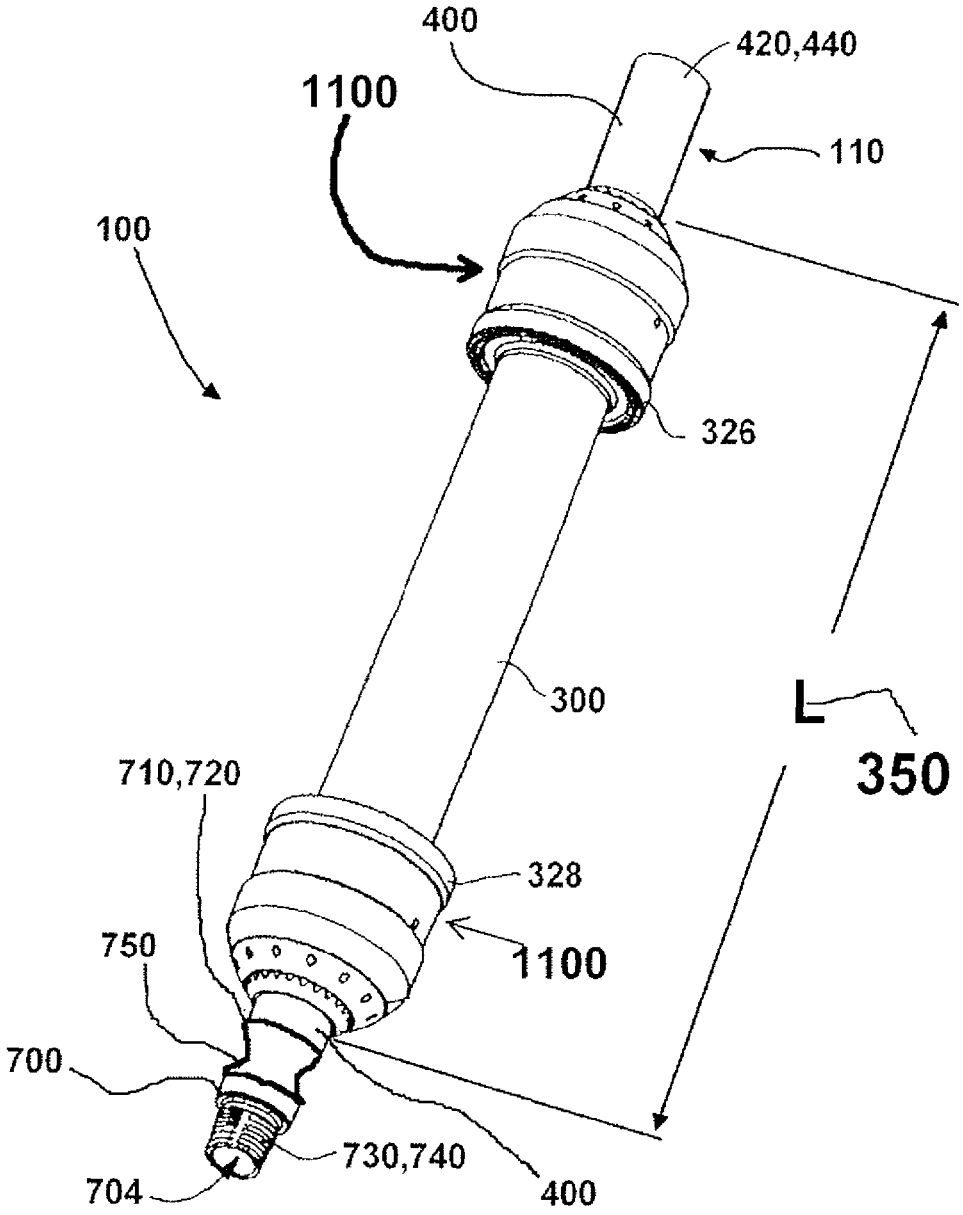
FIG. 5 is a perspective view of a rotating and reciprocating swivel with a double box mandrel.

FIG. 5 is a schematic diagram of one embodiment of a swivel 100 which can rotate and/or reciprocate. With such construction drill or well string 85 can be rotated and/or reciprocated while annular blowout preventer 70 is sealed around swivel 100. Swivel 100 includes a sleeve or housing 300.

Mandrel 110 is contained within a bore of sleeve 300. Swivel 100 includes an outer sleeve or housing 300 having a generally vertically oriented open-ended bore that is occupied by mandrel 110. Sleeve 300 provides upper catch, shoulder or flange 326 and lower catch, shoulder or flange 328.

Maintaining Sealing Between Mandrel and Sleeve During Rotation and/or Reciprocation FIGS. 10-13 schematically illustrating reciprocating motion of sleeve or housing 300 relative to mandrel 110. In these figures arrows 1000, 1010, 1020, and 1030 schematically indicate upward movement of mandrel 110 relative to sleeve 300. Additionally, arrows 1002, 1012, 1022, and 1032 schematically indicate downward movement of mandrel 110 relative to sleeve 300.

The height $H_T$ of mandrel 110 compared to the overall length 350 of sleeve or housing 300 can be configured to allow sleeve or housing 300 to reciprocate (e.g., slide up and down) relative to mandrel 110. FIGS. 10 through 13 are schematic diagrams illustrating reciprocation and/or rotation between sleeve or housing 300 along mandrel 110 (allowing reciprocation and/or rotation between drill or work string 85 when annular seal 71 of annular blow out preventer 70 is closed and sealed on sleeve 300, and drill or work string 85, thereby sealing the bore hole from above).

FIGS. 10 through 13 (in such order) with arrows 1000, 1010, 1020, and 1030 schematically indicate an upward stroke of reciprocation of mandrel 110 relative to sleeve 300.

Figure 10:
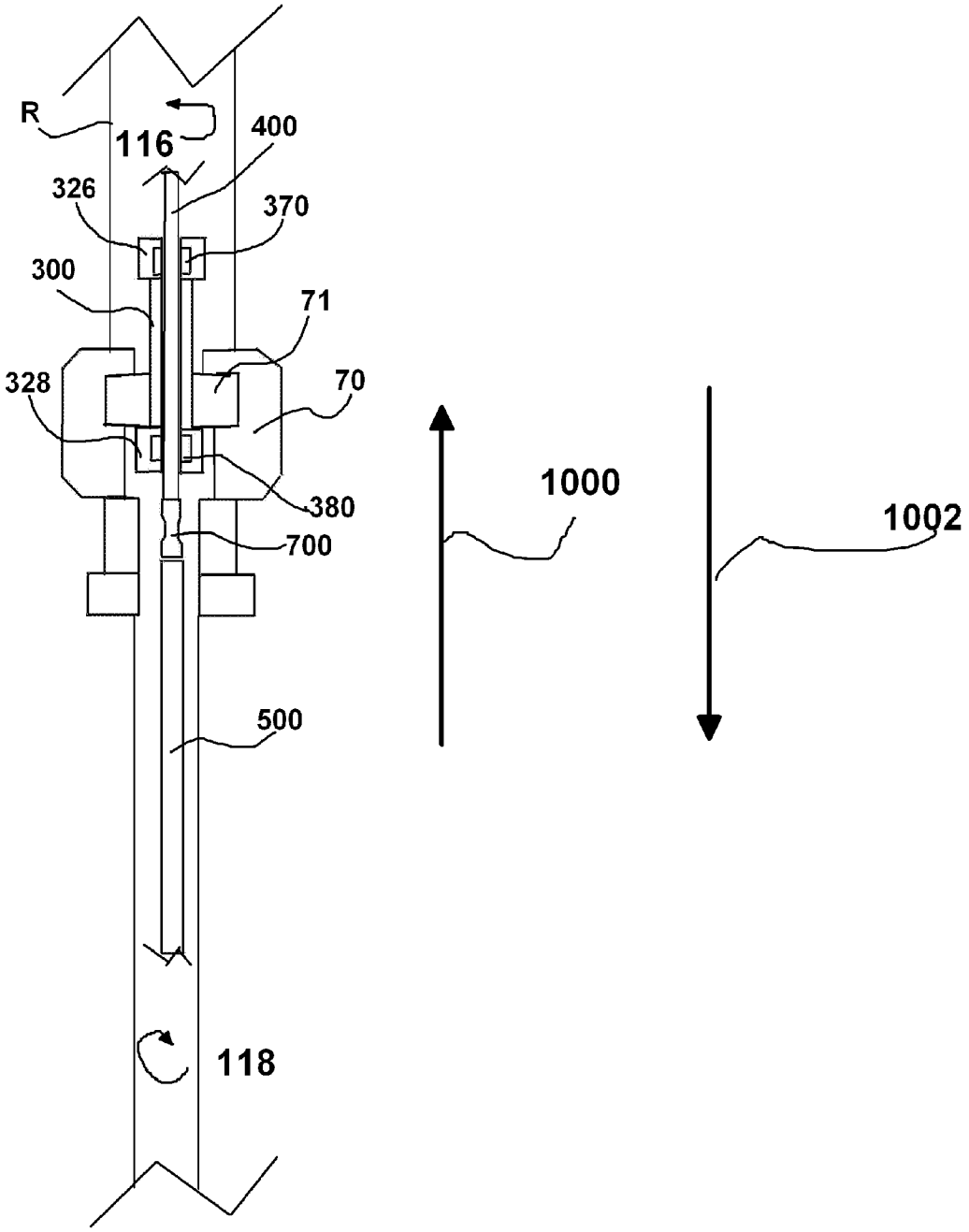
FIGS. 10 through 13 are schematic diagrams illustrating reciprocating motion of a drill or well string through an annular blowout preventer.

In FIG. 10, arrow 1000 schematically indicates that mandrel 110 is moving upward relative to sleeve or housing 300, where a double pin end sub 700 is located below lower packing unit 380 of sleeve 300. Both packing units 370 and 380 maintain a seal between sleeve 300 and mandrel 110, while annular seal 71 maintains a seal on sleeve 300 thereby sealing wellbore 40.

Figure 11:
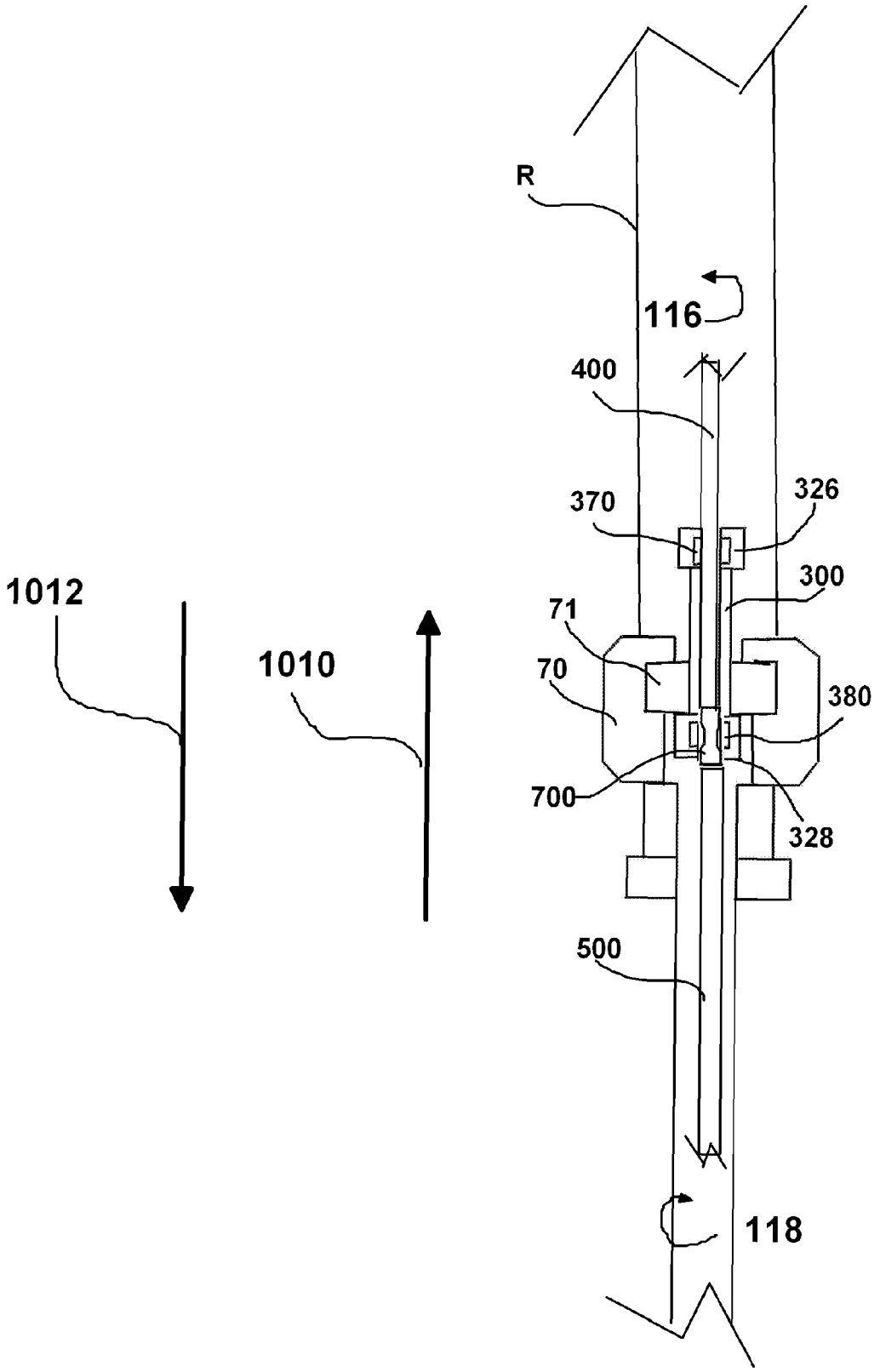

In FIG. 11, arrow 1010 schematically indicates that mandrel 110 is moving upward relative to sleeve or housing 300, where a double pin end sub 700 is located at the level of lower packing unit 380 of sleeve 300. While packing unit 380 may not maintain a seal when double pin end sub 700 passes through (e.g., recessed area 750 causing a break in the sealing), packing unit 370 maintains a seal between sleeve 300 and mandrel 110, while annular seal 71 maintains a seal on sleeve 300 thereby sealing wellbore 40.

Figure 12:
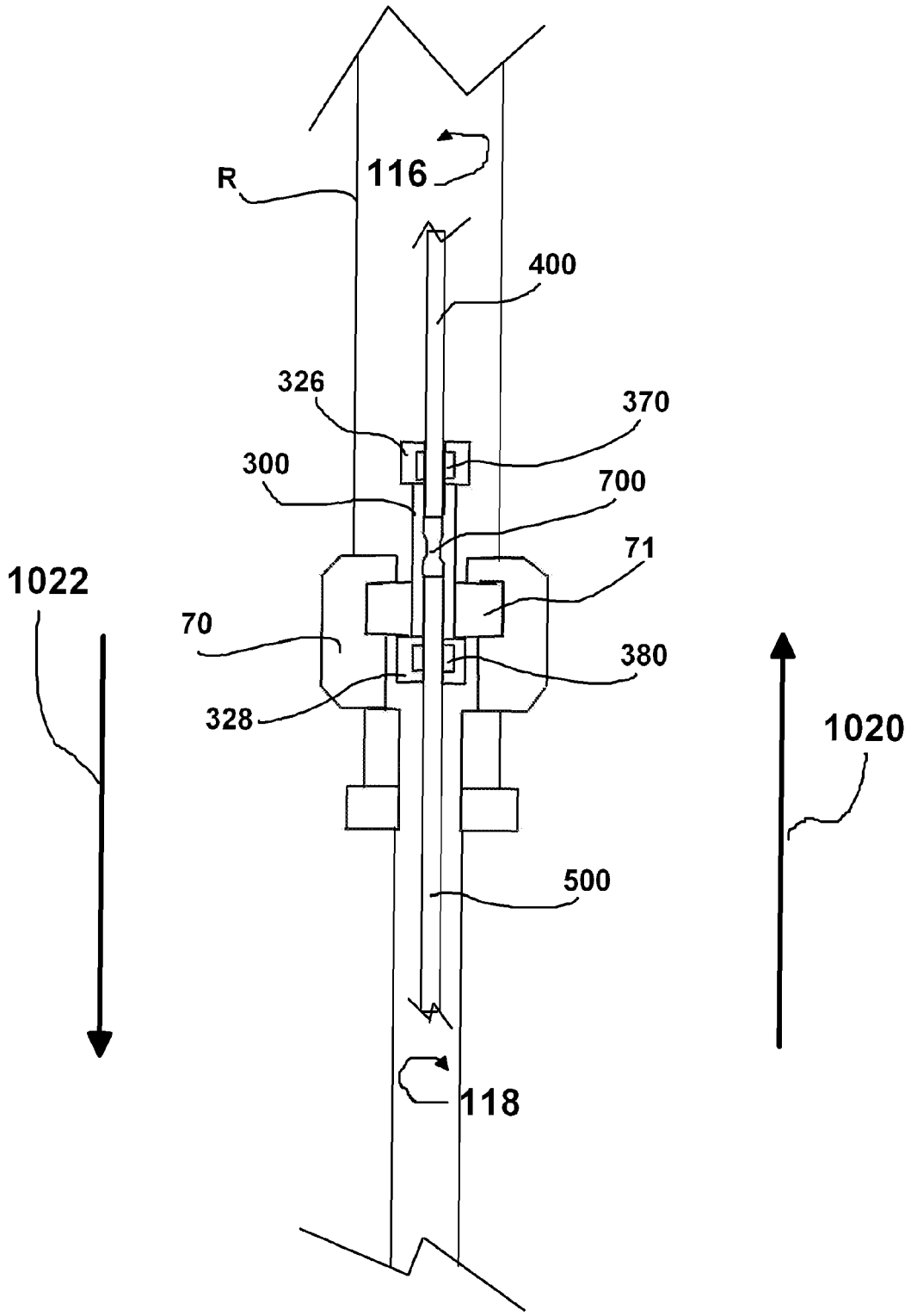

In FIG. 12, arrow 1020 schematically indicates that mandrel 110 is moving upward relative to sleeve or housing 300, where a double pin end sub 700 is located between upper packing 370 and lower packing 380 units. Both packing units 370 and 380 maintain a seal between sleeve 300 and mandrel 110, while annular seal 71 maintains a seal on sleeve 300 thereby sealing wellbore 40.

Figure 13:
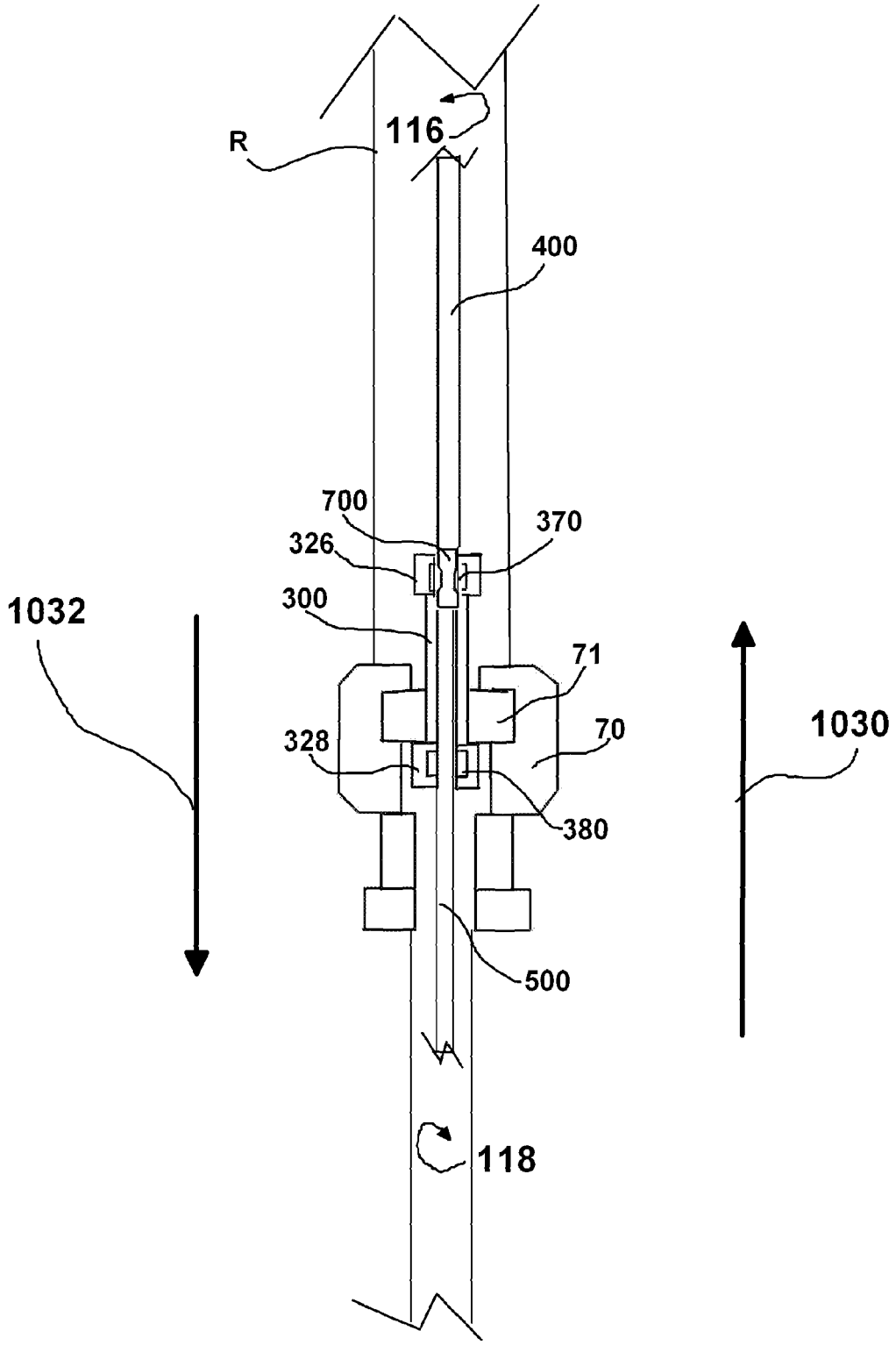

In FIG. 13, arrow 1030 schematically indicates that mandrel 110 is moving upward relative to sleeve or housing 300, where a double pin end sub 700 is located at the level of upper packing 370 unit of sleeve 300. While packing unit 370 may not maintain a seal when double pin end sub 700 passes through (e.g., recessed area 750 causing a break in the sealing), packing unit 380 maintains a seal between sleeve 300 and mandrel 110, while annular seal 71 maintains a seal on sleeve 300 thereby sealing wellbore 40.

FIGS. 13 through 10 (in such order) with arrows 1002, 1012, 1022, and 1032 schematically indicate a downward stroke of reciprocation of mandrel 110 relative to sleeve 300.

In FIG. 13, arrow 1032 schematically indicates that mandrel 110 is moving downward relative to sleeve or housing 300, where a double pin end sub 700 is located at the level of upper packing 370 unit of sleeve 300. While packing unit 370 may not maintain a seal when double pin end sub 700 passes through (e.g., recessed area 750 causing a break in the sealing), packing unit 380 maintains a seal between sleeve 300 and mandrel 110, while annular seal 71 maintains a seal on sleeve 300 thereby sealing wellbore 40.

In FIG. 12, arrow 1022 schematically indicates that mandrel 110 is moving downward relative to sleeve or housing 300, where a double pin end sub 700 is located between upper packing 370 and lower packing 380 units. Both packing units 370 and 380 maintain a seal between sleeve 300 and mandrel 110, while annular seal 71 maintains a seal on sleeve 300 thereby sealing wellbore 40.

In FIG. 11, arrow 1012 schematically indicates that mandrel 110 is moving downward relative to sleeve or housing 300, where a double pin end sub 700 is located at the level of lower packing unit 380 of sleeve 300. While packing unit 380 may not maintain a seal when double pin end sub 700 passes through (e.g., recessed area 750 causing a break in the sealing), packing unit 370 maintains a seal between sleeve 300 and mandrel 110, while annular seal 71 maintains a seal on sleeve 300 thereby sealing wellbore 40.

In FIG. 10, arrow 1002 schematically indicates that mandrel 110 is moving downward relative to sleeve or housing 300, where a double pin end sub 700 is located below lower packing unit 380 of sleeve 300. Both packing units 370 and 380 maintain a seal between sleeve 300 and mandrel 110, while annular seal 71 maintains a seal on sleeve 300 thereby sealing wellbore 40.

In FIGS. 10 through 13, Arrows 116 and 118 indicate relative rotational movement of mandrel 110 relative to sleeve 30 when annular seal 71 is closed on sleeve 300. Arrows 116 schematically indicate clockwise rotation of mandrel 110 relative to sleeve or housing 300. Arrows 118 schematically indicates counter-clockwise rotation of mandrel 110 relative to sleeve or housing 300. The change in direction between arrows 116 and 118 schematically indicates an alternating type of rotational movement.

The change in direction between vertical pairs of arrows (1000, 1002; 1010, 1012; 1020, 1022; and 1030, 1032) schematically indicates a reciprocating motion of mandrel 110 relative to sleeve 300.

Swivel 100 can be made up of mandrel 110 to fit in line of a drill or work string 85 and sleeve or housing 300 with a seal and bearing system to allow for the drill or work string 85 to be rotated and reciprocated while swivel 100 where annular seal unit 71 is closed on sleeve 300. This can be achieved by locating swivel 100 in the annular blow out preventer 70 where annular seal unit 71 can close around sleeve or housing 300 forming a seal between sleeve or housing 300 and annular seal unit 71.

Figures 3, 4:
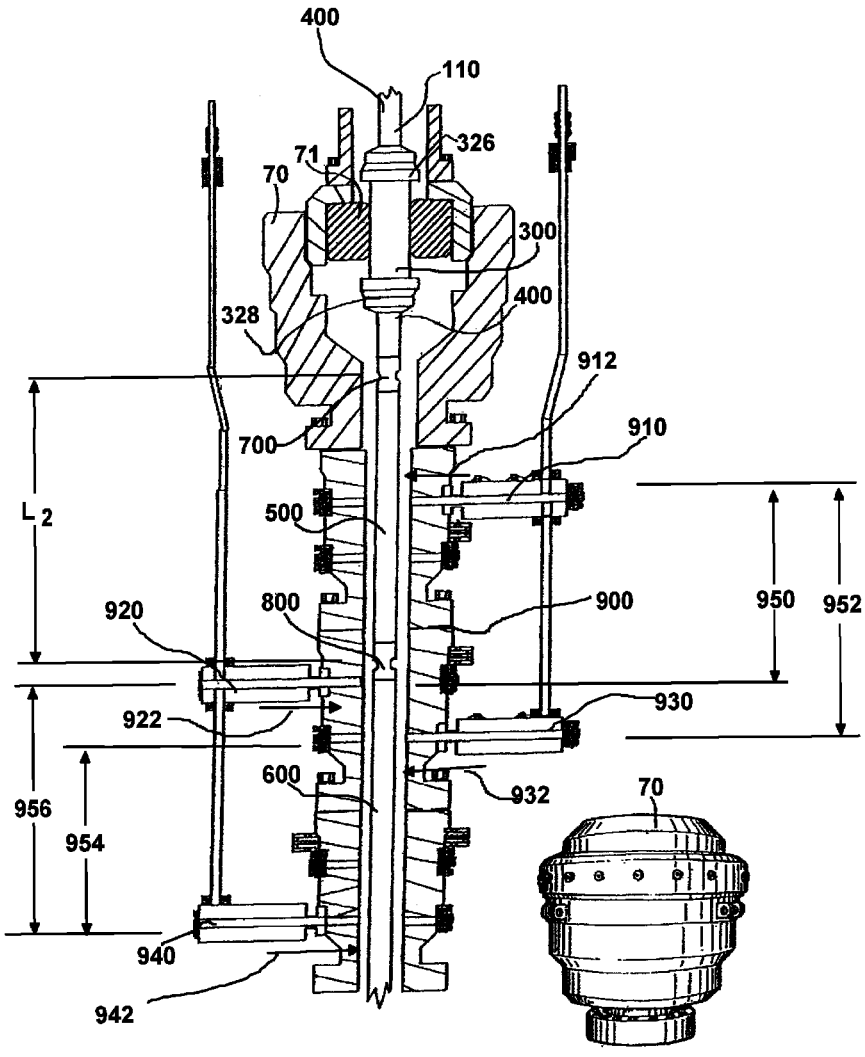
FIG. 3 is a perspective view of a conventionally available annular blowout preventer.
FIG. 4 is a sectional view cut through the annular and ram blow out preventers of FIG. 2 with the annular seal closed on the sleeve of the rotating and reciprocating swivel.

The amount of reciprocation (or stroke) can be controlled by the difference between the height $H_T$ of mandrel 110 and the length 350 of the sleeve or housing 300. As shown in FIG. 3, the stroke of swivel 100 can be the difference between height $H_T$ 180 of mandrel 110 and length 350 of sleeve or housing 300.

In one embodiment height $H_T$ 180 can be about eighty feet (24.38 meters) and length L1 350 can be about eleven feet (3.35 meters). In other embodiments the length L1 350 can be about 1 foot (30.48 centimeters), about 2 feet (60.98 centimeters), about 3 feet (91.44 centimeters), about 4 feet (122.92 centimeters), about 5 feet (152.4 centimeters), about 6 feet (183.88 centimeters), about 7 feet (213.36 centimeters), about 8 feet (243.84 centimeters), about 9 feet (274.32 centimeters), about 10 feet (304.8 centimeters), about 12 feet (365.76 centimeters), about 13 feet (396.24 centimeters), about 14 feet (426.72 centimeters), about 15 feet (457.2 centimeters), about 16 feet (487.68 centimeters), about 17 feet (518.16 centimeters), about 18 feet (548.64 centimeters), about 19 feet (579.12 centimeters), and about 20 feet (609.6 centimeters) (or about midway spaced between any of the specified lengths). In various embodiments, the length of the swivel's sleeve or housing 300 compared to the length H180 of its mandrel 110 is between two and thirty times. Alternatively, between two and twenty times, between two and fifteen times, two and ten times, two and eight times, two and six times, two and five times, two and four times, two and three times, and two and two and one half times. Also alternatively, between 1.5 and thirty times, 1.5 and twenty times, 1.5 and fifteen times, 1.5 and ten times, 1.5 and eight times, 1.5 and six times, 1.5 and five times, 1.5 and four times, 1.5 and three times, 1.5 and two times, 1.5 and two and one half times, and 1.5 and two times.

In various embodiments, at least partly during the time annular seal 71 is closed on sleeve 300, the drill or well string 85 is reciprocated longitudinally the distance of at least about ½ inch (1.27 centimeters), about 1 inch (2.54 centimeters), about 2 inches (5.04 centimeters), about 3 inches (7.62 centimeters), about 4 inches (10.16 centimeters), about 5 inches (12.7 centimeters), about 6 inches 15.24 centimeters), about 1 foot (30.48 centimeters), about 2 feet (60.96 centimeters), about 3 feet (91.44 centimeters), about 4 feet (1.22 meters), about 6 feet (1.83 meters), about 10 feet (3.048 meters), about 15 feet (4.57 meters), about 20 feet (6.096 meters), about 25 feet (7.62 meters), about 30 feet (9.14 meters), about 35 feet (10.67 meters), about 40 feet (12.19 meters), about 45 feet (13.72 meters), about 50 feet (15.24 meters), about 55 feet (16.76 meters), about 60 feet (18.29 meters), about 65 feet (19.81 meters), about 70 feet (21.34 meters), about 75 feet (22.86 meters), about 80 feet (24.38 meters), about 85 feet (25.91 meters), about 90 feet (27.43 meters), about 95 feet (28.96 meters), about 100 feet (30.48 meters), and/or between the range of each or a combination of each of the above specified distances.

Swivel 100 can be comprised of mandrel 110 and sleeve or housing 300. Sleeve or housing 300 can be rotatably, reciprocably, and/or sealably connected to mandrel 110. Accordingly, when mandrel 110 is rotated and/or reciprocated sleeve or housing 300 can remain stationary to an observer insofar as rotation and/or reciprocation is concerned. Sleeve or housing 300 can fit over mandrel 110 and can be rotatably, reciprocably, and sealably connected to mandrel 110.

Sleeve or housing 300 can be rotatably connected to mandrel 110 by one or more bushings and/or bearings 1100, preferably located on opposed longitudinal ends of sleeve or housing 300.

Sleeve or housing 300 can be sealingly connected to mandrel 110 by a one or more seals (e.g., packing units 370 and 380), preferably spaced apart and located on opposed longitudinal ends of sleeve or housing 300. The seals can seal the gap 315 between the interior 310 of sleeve or housing 300 and the exterior of mandrel 110.

Sleeve or housing 300 can be reciprocally connected to mandrel 110 through the geometry of mandrel 110 which can allow sleeve or housing 300 to slide relative to mandrel 110 in a longitudinal direction (such as by having a longitudinally extending distance H 180 of the exterior surface of mandrel 110 a substantially constant diameter).

In one embodiment sealing units 370 and 380 can be two way seals. One advantage of using two sets of sealing units 370 and 380 which each seal in opposite longitudinal directions is that the sleeve 300 and mandrel 110, even where one or of the double pin subs (e.g., 700, 800, etc.) with its recessed portion (e.g., 750, 850, etc.) passing through the sealing unit, the spaced apart sealing unit can still seal against fluid flow. This backup sealing ability assists in maintaining sealing during vertical movement of mandrel 110 relative to sleeve 300.

Double Box End Mandrel can be of Different Heights

Figure 6:
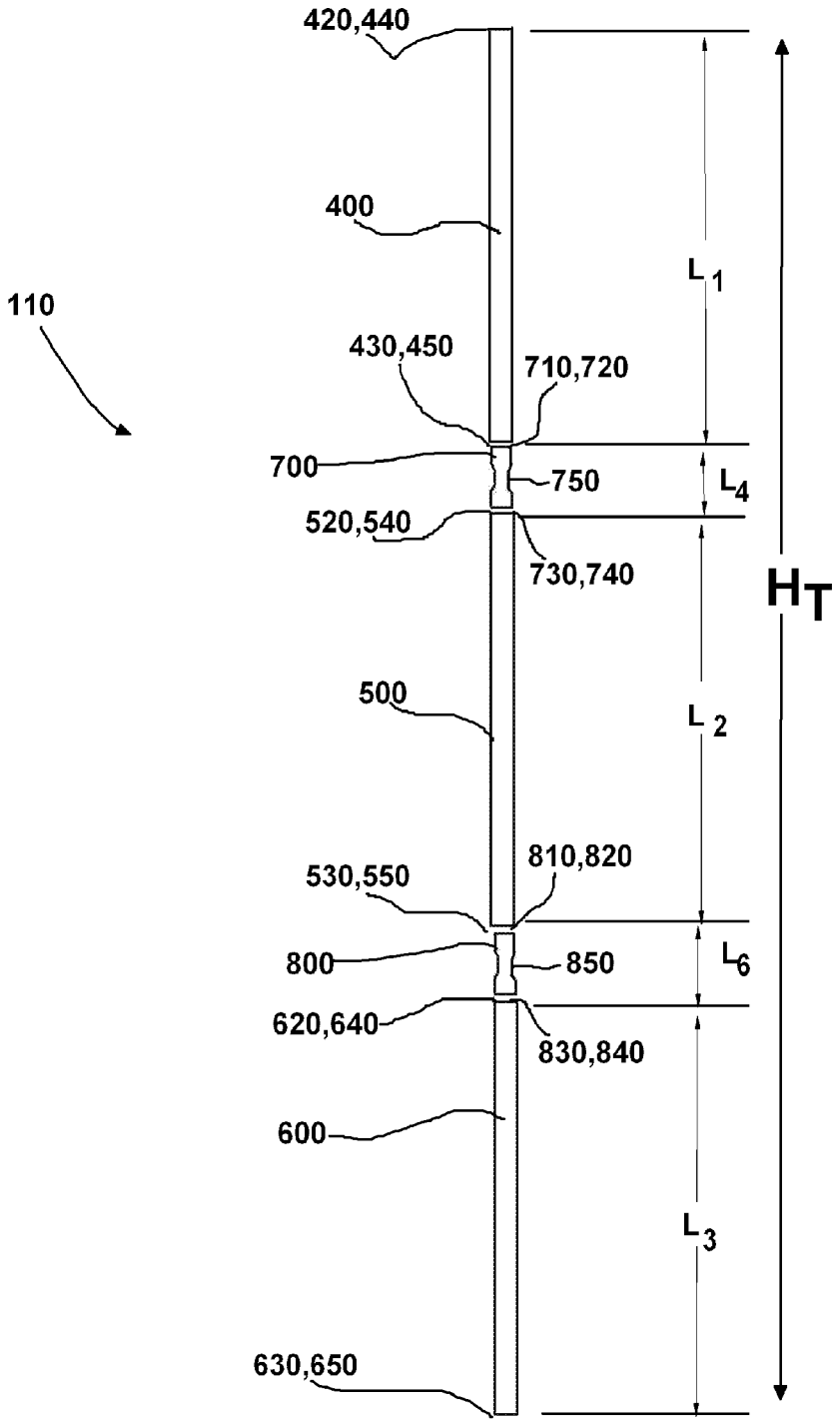
FIG. 6 is a schematic view of one embodiment of a mandrel which includes a plurality of double box end joints connected by a plurality of double pin end subs.

FIG. 5 is a perspective view of a rotating and reciprocating swivel 100 with a double box mandrel 110. FIG. 6 is a schematic view of one embodiment of a mandrel 110 which includes a plurality of double box end joints (400, 500, 600) connected by a plurality of double pin end subs (700, 800).

The overall height $H_T$ of double box mandrel 110 can be equal to the sum of the lengths of the joints and subs making it up. In this case the overall height $H_T$ of double box end mandrel 110 is equal to $L_1+L_2+L_3+L_4+L_5$. Double box end mandrel 110 can be converted to a pin end by adding one additional double pin end sub 800' to one of mandrel's 110 ends. To change the overall height $H^T$ (to be either more or less) different numbers of mandrel joints 400, 500, 600 can be used to make up mandrel 110. Another way to change the overall height $H_T$ of mandrel 100 is to use mandrel joints 400, 500, 600 of different lengths.

Figure 7:
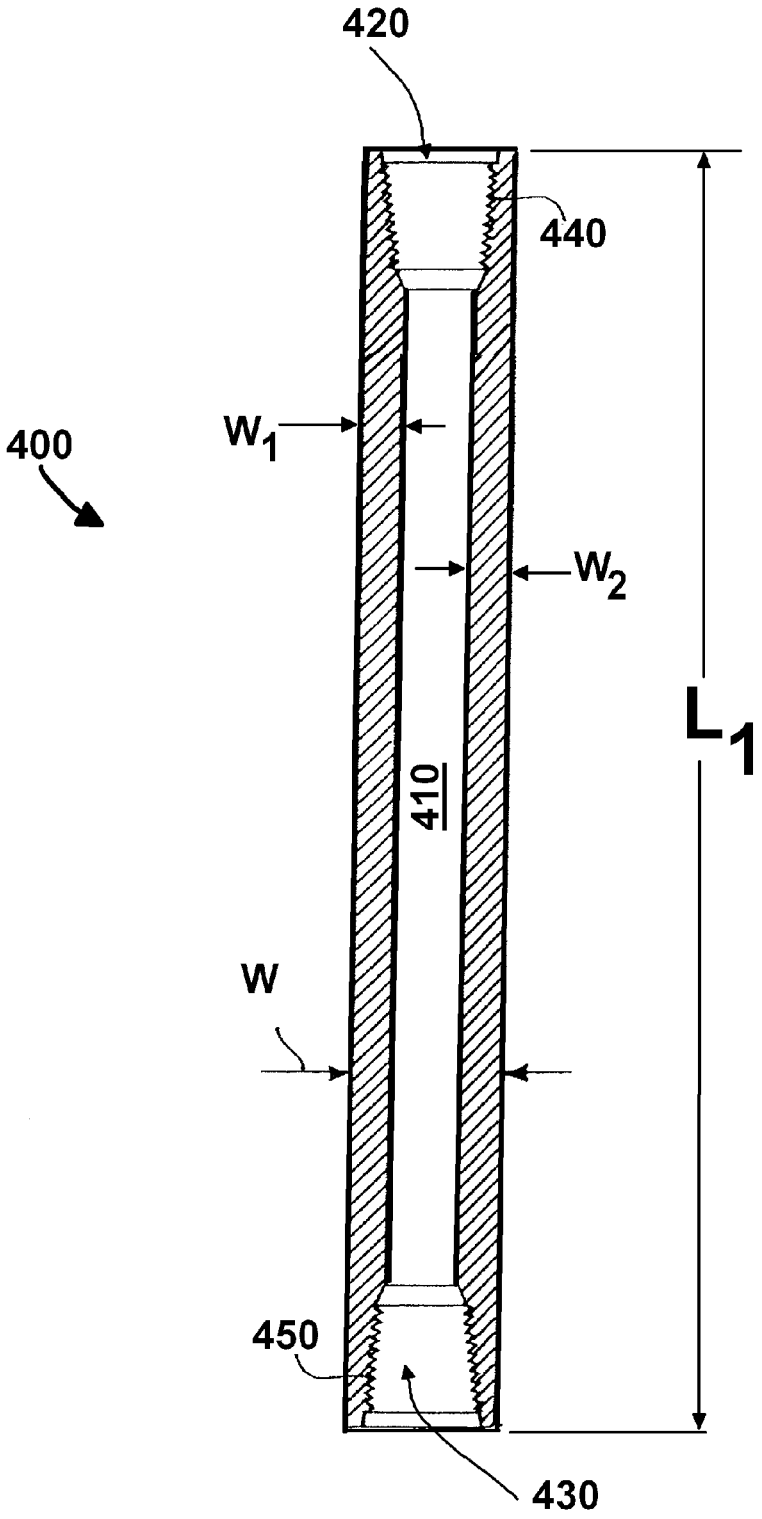
FIG. 7 is a sectional view through one joint of a double box end mandrel.

FIG. 7 is a sectional view through one joint of a double box end mandrel joint 400. Double box end joint 400 can be of a length $L_1$, and can include longitudinal passage 410 with a box connection 440 at its upper end 420 along with box connection 450 at its lower end 430. Mandrel joint 400 can have wall thicknesses $W_1$ and $W_2$ (which are preferably equal or uniform).

Double box end joint 500 can be of a length $L_2$, and can include longitudinal passage 510 with a box connection 540 at its upper end 520 along with box connection 550 at its lower end 530.

Double box end joint 600 can be of a length $L_3$, and can include longitudinal passage 610 with a box connection 640 at its upper end 620 along with box connection 650 at its lower end 630.

Figure 8:
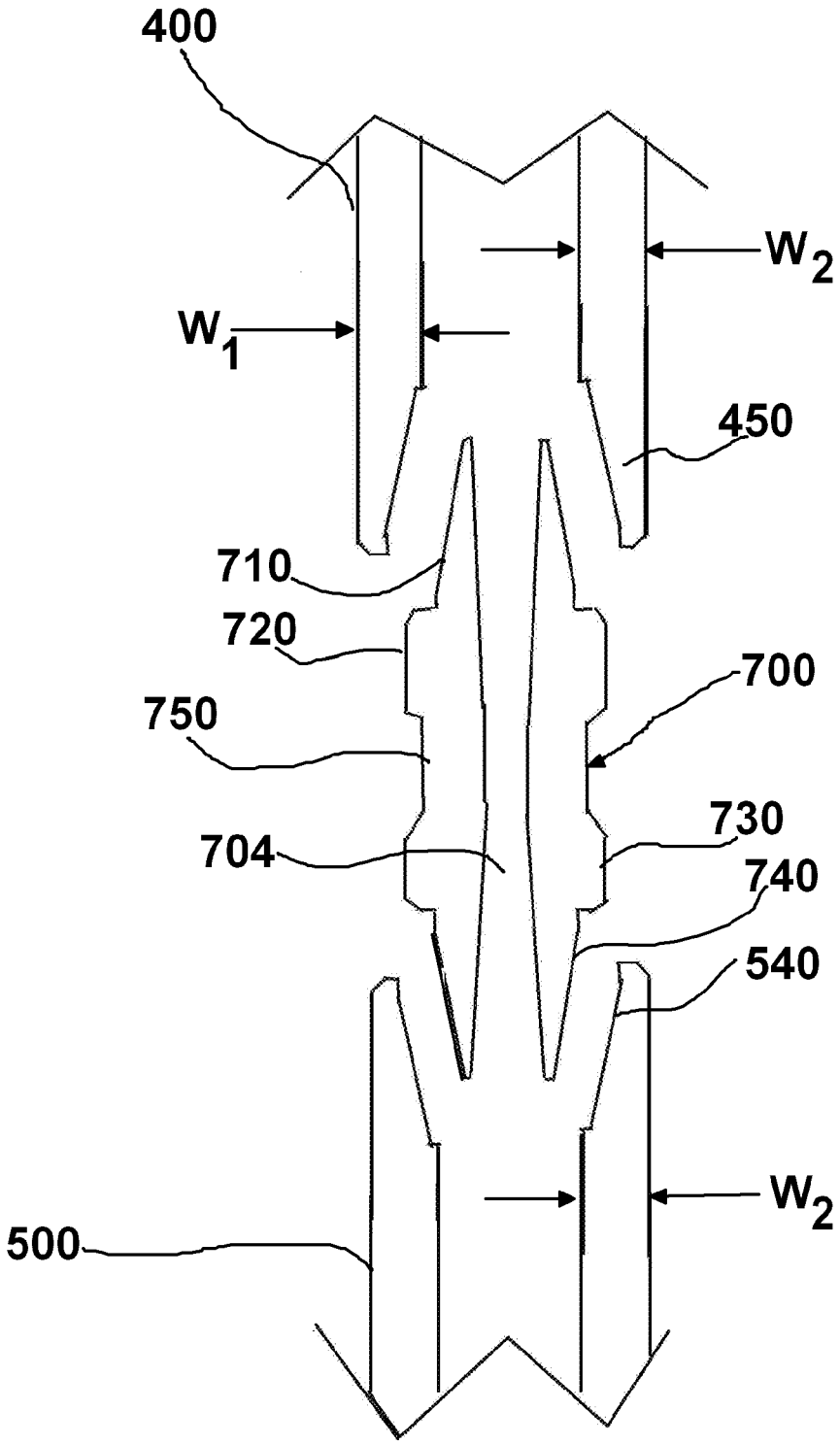
FIG. 8 is a close up sectional and schematic view of the connection between two double box end joints and a double pin end sub.

FIG. 8 is a close up sectional and schematic view of the connection between two double box end joints and a double pin end sub. Here mandrel joint 400 is being connected to mandrel joint 500 with double pin end sub 700.

Double pin sub 700 can comprise upper end 710, lower end 740 along with longitudinal passage 704. Sub 700 can also include upper shoulder 720, lower shoulder 730, and recessed area 750.

Recessed area 750 can be used for handling mandrel 110 after joints 400, 500, 600, etc. have been connected to each other forming mandrel 110. Handling mandrel 110 without using the sealing surfaces of joints 400, 500, 600, etc. for handling prevents such surfaces from being scratched and/or damaged thus causing problems or failure of a seal between mandrel 110 and sleeve 300 (i.e., sealing with seal units 370 and/or 380). Additionally, handling using the double pin subs, where such subs are damaged, allows replacement of the subs 700, 800, etc., while protecting (and preventing the require to replace) the more expensive mandrel joint pieces 400, 600, 700, etc.

Box connection 450 of joint 400 can be threadably connected to upper end 710 of double pin sub 700. Box connection 540 of mandrel joint 500 can be threadably connected to lower end 740 of double pin sub 700.

Figure 9:
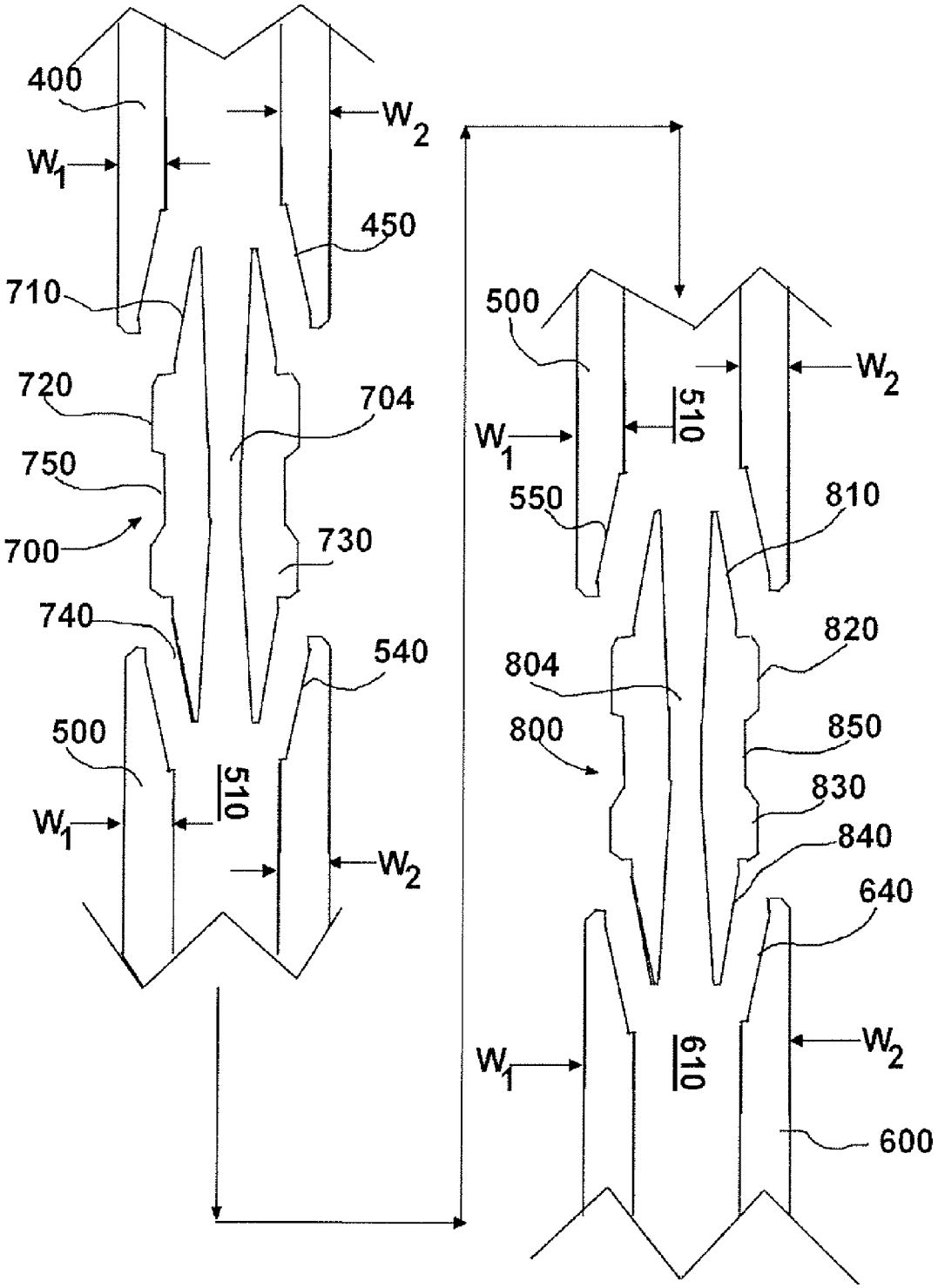
FIG. 9 is a close up sectional and schematic view of the connections between three double box end joints and two double pin end subs.

FIG. 9 is a close up sectional and schematic view of the connections between three double box end joints 400, 500, 600 and two double pin end subs 700, 800. Here mandrel joints 400, 500, and 600 are being connected using double pin end subs 700 and 800 (see also FIG. 6).

Double pin sub 800 can comprise upper end 810, lower end 840 along with longitudinal passage 804. Sub 800 can also include upper shoulder 820, lower shoulder 830, and recessed area 550.

Box connection 450 of joint 400 can be threadably connected to upper end 710 of double pin sub 700. Box connection 540 of mandrel joint 500 can be threadably connected to lower end 740 of double pin sub 700.

Box connection 550 of joint 500 can be threadably connected to upper end 810 of double pin sub 800. Box connection 640 of mandrel joint 600 can be threadably connected to lower end 840 of double pin sub 800.

Now, recessed areas 750 and/or 850 can be used for handling mandrel 110 after joints 400, 500, 600, etc. have been connected to each other forming mandrel 110. Handling mandrel 110 without using the sealing surfaces of joints 400, 500, 600, etc. for handling prevents such surfaces from being scratched and/or damaged thus causing problems or failure of a seal between mandrel 110 and sleeve 300 (i.e., sealing with seal units 370 and/or 380). Additionally, handling using the double pin subs, where such subs are damaged, allows replacement of the subs 700, 800, etc., while protecting (and preventing the require to replace) the more expensive mandrel joint pieces 400, 600, 700, etc.

Mandrel is Shearable for Ram Blow Out Preventer Regardless of Vertical Position of Mandrel The wall thickness ($W_1$ and $W_2$) of double box end joints 400, 500, 600, etc. will be such that the walls can be sheared by one of the rams 910, 920, 930, and/or 940 of ram blow out preventer 900.

In one embodiment the spacing between double pin subs 700, 800, etc. is such that at any one point in time only one of such subs 700, 800, and/or another double pin sub can be aligned with a ram of a ram blow out preventer.

FIG. 4 is a sectional view cut through the annular 70 and ram 900 blow out preventers with the annular seal 71 closed on the sleeve 300 of the rotating and reciprocating swivel 100. Mandrel 110 which comprises mandrel joints 400, 500, 600 connected together by double pin subs 700, 800 are also schematically shown in FIG. 4.

Schematically shown in FIG. 4 is the spacing between subs 700 and 800 is such that at any one point in time only one of subs 700 or 800 can be aligned with a ram of a ram blow out preventer Ram blow out preventer 700 can include rams 910, 920, 930, and 940. Distance 950 is between rams 910 and 920. Distance 952 is between rams 910 and 930. Distance 954 is between rams 930 and 940. Distance 956 is between rams 920 and 940. Distance 958 is between rams 920 and 930.

In this embodiment none of the distances 950, 952, 954, 956, and/or 958 can fall within the range of:

$$L_1 +/- (L_4 + L_6)$$

In this manner there is no possibility that more than one ram (910, 920, 930, and/or 940) can land on a double pin sub 700, 800, etc., regardless of the amount of longitudinal reciprocation of mandrel 110 relative to sleeve 300, or the longitudinal position of mandrel 110 relative to ram blow out preventer 900 (assuming that sleeve 300 is not positioned in ram blow out preventer 900).

In one embodiment the length of any double box end joint 400, 500, 600, etc. is greater than at least about 4 feet. In other embodiments the length is at least greater than about 5, 6, 7, 8, 9, 10, 12, 14, 15, 16, 18, 20, 25, 30, 35, and 40 feet. In other embodiments the length is between any two of the above specified lengths.

The wall thickness ($W_1$ and $W_2$) of double box end joints 400, 500, 600, etc. will be such that the walls can be sheared by one of the rams 910, 920, 930, and/or 940 of ram blow out preventer 900.

While certain novel features of this invention shown and described herein are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

The following is a parts list of reference numerals or part numbers and corresponding descriptions as used herein:

LIST FOR REFERENCE NUMERALS

| Reference Numeral | Description |
|---|---|
| 10 | drilling rig/well drilling apparatus |
| 20 | drilling fluid line |
| 22 | drilling fluid or mud |
| 30 | rotary table |
| 40 | well bore |
| 70 | annular blowout preventer |

-continued

LIST FOR REFERENCE NUMERALS

| Reference Numeral | Description |
|---|---|
| 71 | annular seal unit |
| 75 | stack |
| 80 | riser |
| 85 | drill or work string |
| 87 | seabed |
| 88 | well head |
| 90 | upper volumetric section |
| 92 | lower volumetric section |
| 100 | swivel |
| 110 | mandrel |
| 300 | swivel sleeve or housing |
| 302 | upper end |
| 304 | lower end |
| 310 | interior section |
| 315 | gap |
| 326 | upper catch, shoulder, flange |
| 328 | lower catch, shoulder, flange |
| 350 | L1 - - overall length of sleeve or housing with attachments on upper and lower ends |
| 370 | first seal |
| 380 | second seal |
| 400 | double box mandrel joint |
| 410 | longitudinal passage |
| 420 | upper end |
| 430 | lower end |
| 440 | box connection |
| 450 | box connection |
| 460 | central longitudinal passage |
| 500 | double box mandrel joint |
| 510 | longitudinal passage |
| 520 | upper end |
| 530 | lower end |
| 540 | box connection |
| 550 | box connection |
| 560 | central longitudinal passage |
| 600 | double box mandrel joint |
| 610 | longitudinal passage |
| 620 | upper end |
| 630 | lower end |
| 640 | box connection |
| 650 | box connection |
| 660 | central longitudinal passage |
| 700 | double pin end sub |
| 704 | longitudinal passage |
| 710 | first pin end |
| 720 | first shoulder |
| 730 | second pin end |
| 740 | second shoulder |
| 750 | recessed area |
| 800 | double pin end sub |
| 804 | longitudinal passage |
| 810 | first pin end |
| 820 | first shoulder |
| 830 | second pin end |
| 840 | second shoulder |
| 850 | recessed area |
| ABOP | annular blow out preventer |
| BJ | ball joint |
| BL | booster line |
| CM | choke manifold |
| CL | diverter line |
| CM | choke manifold |
| D | diverter |
| DL | diverter line |
| F | rig floor |
| IB | inner barrel |
| KL | kill line |
| MP | mud pit |
| MB | mud gas buster or separator |
| OB | outer barrel |
| R | riser |
| RAM BOP | ram blow out preventer |
| RF | flow line |
| S | floating structure or rig |
| SJ | slip or telescoping joint |

-continued

LIST FOR REFERENCE NUMERALS

| Reference Numeral | Description |
|---|---|
| SS | shale shaker |
| W | wellhead |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A method of using a reciprocating swivel in a drill or work string, the method comprising the following steps:

(a) lowering a rotating and reciprocating tool to a blow out preventer, the tool comprising a mandrel and a sleeve, the sleeve being reciprocable relative to the mandrel and the mandrel including at least one joint having double box ends with the joint being severable by a ram blow out preventer, the sleeve having two spaced apart sealing units, the swivel including an interstitial space between the sleeve and the mandrel with first and second spaced apart sealing units each scaling the interstitial space;

(b) after step "a", having the blow out preventer close on the sleeve; and (c) after step "b", causing relative longitudinal movement between the sleeve and the mandrel, wherein in step "a" the mandrel includes two double box end joints which are connected by a double pin end sub, and in step "c" when the double pin end sub is at the same longitudinal position as the first sealing unit, the first sealing unit loses its seal of the interstitial space, but the second sealing keeps its seal of the interstitial space.

2. The method of claim 1, wherein after the double pin end sub passes by the first scaling unit, the first sealing unit regains its seal of the interstitial space.

3. The method of claim 2, wherein when the double pin end sub is at the same longitudinal position as the second scaling unit, the second scaling unit loses its seal of the interstitial space, but the first scaling keeps its seal of the interstitial space.

4. The method of claim 3, wherein after the double pin end sub passes by the second scaling unit, the second sealing unit regains its seal of the interstitial space.

5. The method of claim 1, further comprising the step of after step "c", moving the sleeve outside of the blow out preventer.

6. The method of claim 5, further comprising the step of moving the sleeve back inside of the blow out preventer and having the blow out preventer close on the sleeve.

7. The method of claim 6, further comprising the step of, after moving the sleeve back inside the annular blow out preventer causing relative longitudinal movement between the sleeve and the mandrel and activating a quick lock/quick unlock system from an unlocked state to a locked state, causing an amount that the sleeve is reciprocable relative to the mandrel in the locked state to be reduced compared to the amount that the sleeve is reciprocable relative to the mandrel in the unlocked state.

8. A method of using a reciprocating swivel in a drill or work string, the method comprising the following steps:

(a) lowering a rotating and reciprocating tool to a blow out preventer, the tool comprising a mandrel and a sleeve, the sleeve being reciprocable relative to the mandrel and the mandrel including at least one joint having double box ends with the joint being severable by a ram blow out preventer, the sleeve having two spaced apart sealing units, the swivel including an interstitial space between the sleeve and the mandrel with first and second spaced apart scaling units each scaling the interstitial space;

(b) after step "a", having the blow out preventer close on the sleeve; and (c) after step "b", causing relative longitudinal movement between the sleeve and the mandrel, wherein in step "a" the mandrel includes two double box end joints which are connected by a double pin end sub, and in step "c" when the double pin end sub is at the same longitudinal position as the second sealing unit, the second sealing unit loses its seal of the interstitial space, but the first sealing keeps its seal of the interstitial space.

9. The method of claim 8, wherein after the double pin end sub passes by the second sealing unit, the second sealing unit regains its seal of the interstitial space.

10. The method of claim 9, wherein when the double pin end sub is at the same longitudinal position as the first sealing unit, the first scaling unit loses its seal of the interstitial space, but the second scaling keeps its seal of the interstitial space.

11. The method of claim 10, wherein after the double pin end sub passes by the first sealing unit, the first sealing unit regains its seal of the interstitial space.

* * * * *